United States Patent [19]

Garofalo

[11] Patent Number: 5,020,531

[45] Date of Patent: Jun. 4, 1991

[54] AUTOMATIC REGULATOR FOR BREATHING APPARATUS

[75] Inventor: Giovanni Garofalo, Rapallo, Italy

[73] Assignee: AMF Mares S.p.A., Italy

[21] Appl. No.: 447,833

[22] Filed: Dec. 8, 1989

[30] Foreign Application Priority Data

Dec. 29, 1988 [IT] Italy ..... 15184/88[U]

[51] Int. Cl.[5] ..... A62B 9/02; A62B 18/10

[52] U.S. Cl. ..... 128/205.24; 128/201.28

[58] Field of Search ..... 128/201.27, 201.28, 128/205.22, 205.24, 206.45, 207.16, 207.12

[56] References Cited

U.S. PATENT DOCUMENTS

| | | | |
|---|---|---|---|
| 2,406,883 | 9/1946 | Meidenbauer, Jr. | 128/205.24 |
| 3,680,556 | 8/1972 | Morgan | 128/201.27 |
| 3,721,235 | 3/1973 | Ball et al. | 128/205.22 |

FOREIGN PATENT DOCUMENTS

| | | | |
|---|---|---|---|
| 373523 | 5/1932 | United Kingdom | 128/205.24 |
| 2025774 | 1/1980 | United Kingdom | 128/205.24 |
| 2061117 | 5/1981 | United Kingdom | 128/205.24 |

*Primary Examiner*—Edgar S. Burr
*Assistant Examiner*—Kimberly L. Asher
*Attorney, Agent, or Firm*—Larson and Taylor

[57] ABSTRACT

An automatic regulator for breathing apparatus, comprising a chamber which communicates with the breathing apparatus, including therein an air-dispensing valve, and a chamber which communicates with the environment. Said chambers are sealingly separated from each other by means of a flexible membrane which controls the dispensing valve, while the chamber which communicates with the environment is defined exteriorly by a cover provided with a tongue which is obtained by a partial cut in the front face of said cover and which is resiliently deflected inwards by an external depressing force, so as to deflect said membrane towards the interior of the chamber which communicates with the breathing apparatus and to cause the opening of said dispensing valve.

8 Claims, 1 Drawing Sheet

AUTOMATIC REGULATOR FOR BREATHING APPARATUS

BACKGROUND OF THE INVENTION

The invention relates to an automatic regulator for breathing apparatus, comprising a chamber which communicates with the breathing apparatus, including therein an air-dispensing valve, an a chamber which communicates with the environment, said chambers being sealingly separated from each other by means of a flexible membrane which controls the dispensing valve, while the chamber which communicates with the environment is defined exteriorly by a cover provided with pressure means acting on said membrane, for manual control of the dispensing valve.

With an automatic regulator for breathing apparatus of this type, the air output is caused by each inhaling action, due to the inward deflection of the separating membrane, within the chamber communicating with the breathing apparatus, due to the vacuum produced by said inhaling action.

In order to effect an air output in the absence of an inhaling action, said separating membrane may be depressed inwardly of the chamber which communicates with the breathing apparatus, thanks to manually-controlled means provided in the cover which defines exteriorly said chamber which communicates with the environment. Said means generally comprises a pushbutton which is axially slidably mounted in the cover and which is held in its rest condition, i.e. at a certain distance from the membrane, by means of a spring. In this instance, by depressing said pushbutton, said membrane is pushed inwardly of the chamber which communicates with the breathing apparatus, and it causes a manual opening of the dispensing valve.

SUMMARY OF THE INVENTION

The object of the invention is to provide a regulator of the type disclosed above, with a cover comprising pressure means to control the dispensing valve, which is constructed in a considerably simpler and more economical manner, while ensuring an extremely reliable operation.

The invention achieves this objective with a cover for said chamber communicating with the environment, wherein the pressure means is constituted by a tongue which is formed by partly cutting the front face of said cover and which can be resiliently deflected by an external pressure force, so as to deflect the separating membrane inwardly of the chamber which communicates with the breathing apparatus and to cause the opening of the dispensing valve.

The device of the invention, therefore, has the advantage of eliminating the pushbutton and the spring, and, therefore, is of smaller dimensions. The elimination of the pushbutton and spring (which are provided in the covers of the conventional regulators), besides reducing the cost of material, also reduces the cost of labor because the cover according to the invention can be made in a quite simple manner and by a single machining step, whereby the heretofore-required assembling step is no longer needed.

The invention also includes other characteristics which further improve the automatic regulator disclosed above and which form the subject matter of the subclaims.

BRIEF DESCRIPTION OF THE DRAWINGS

The particular characteristics of the invention and the advantages resulting therefrom will become apparent with more details in the description of some preferred embodiments thereof, shown as non-limiting examples in the accompanying drawings, wherein.

DESCRIPTION OF THE PREFERRED EMBODIMENT OF THE INVENTION

Figure 1:
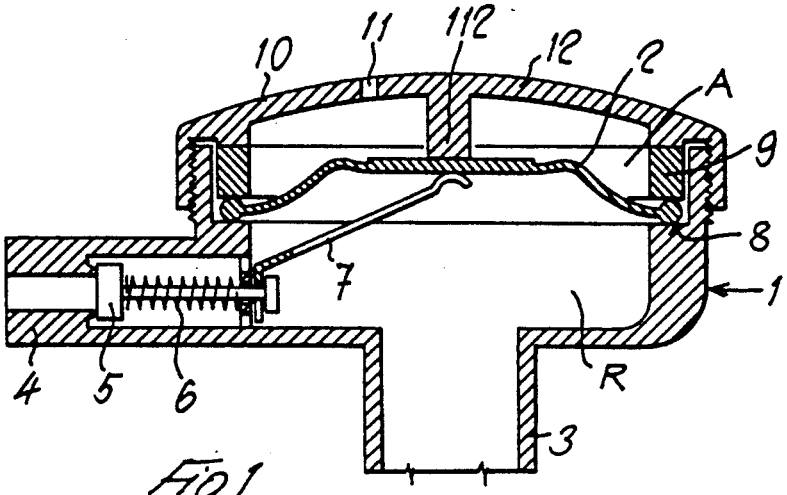
FIG. 1 is an axial sectional view of the regulator according to the invention.

The regulator according to the invention is shown in FIG. 1 and comprises a hollow body of substantially cylindrical shape, generally indicated at 1. The inside cavity of the body 1 is divided into a chamber A which communicates with the environment and a chamber R which communicates with the breathing apparatus, said chambers being sealingly separated from each other by means of a flexible membrane 2. At the chamber R which communicates with the breathing apparatus, the regulator body 1 comprises an axial union 3 for connection to a mouthpiece (not shown) and a radial feed union 4 for connection to an air-feeding conduit (not shown), particularly for supplying the air coming from a first reduction stage.

Arranged in the chamber R which communicates with the breathing apparatus is also a dispensing valve 5 which closes the feed union 4 with the aid of a spring 6, while an actuating lever 7 is swingably connected to one end thereof, the free end of said lever co-operating with the intermediate portion of the membrane 2.

The membrane 2 is sealingly locked, with its peripheral edge sealingly tightened between an annular shoulder 8 of the regulator body 1 and a ring 9 which is pressed against the peripheral edge of the membrane 2 by a cover 10 which is secured, more particularly is screwed, or joint locked on the regulator body 1, at the opposite side with respect to the chamber R which communicates with the breathing apparatus.

The cover 10 forms the front wall of the chamber A which communicates with the environment, to define said chamber exteriorly in a non-sealed manner. It comprises an arcuated front surface wherein a tongue 12 is formed by means of a partial cut, more particularly a slit 11, the free end of said tongue extending to the central region of said cover 10, i.e. to the central region of the membrane 2, and comprising, on the inner side thereof, a protrusion 112 which co-operates with the membrane 2.

Figure 3:
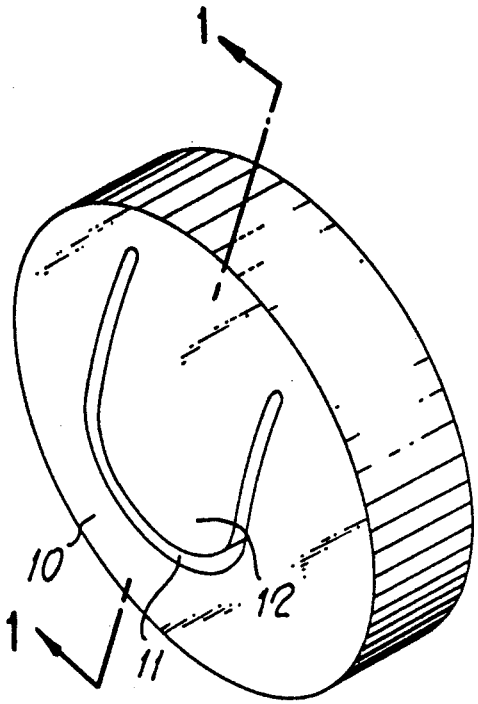
FIGS. 2 and 3 show two different embodiments of the cover of FIG. 1 wherein the line 1—1 of FIG. 3 represents the axial plane of FIG. 1 relative to the cover of FIG. 3.
Figure 2:
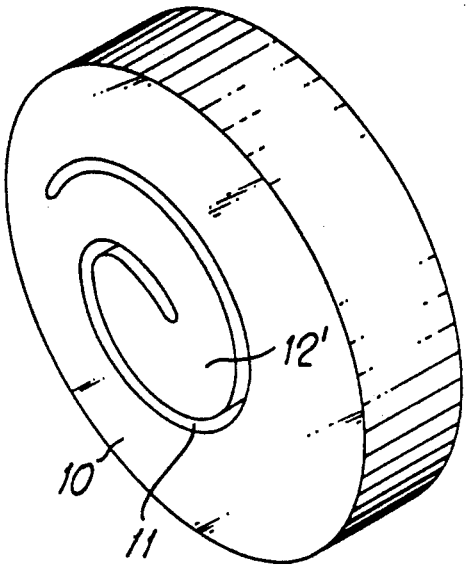

The tongue 12 may have any configuration and, as shown in the FIGS. 2 and 3, it had been more particularly the configuration of a substantially-rectangular tongue with a rounded free end in FIG. 3, while in FIG. 2 it has the configuration of a spiral tongue 12'.

The cover 10, and consequently the tongue 12, are made of a material, more particularly a plastics material, having such resiliency characteristics to permit, under the action of an external depressing force onto the tongue 12, a resilient deflection of the tongue 12 towards the interior of the chamber A which communicates with the environment, so as to deflect as well, through the protrusion 112, the membrane 2 towards the interior of the chamber R which communicates with the breathing apparatus, and, consequently, so as to manually control the actuating lever 7 and, therefore, the dispensing valve 5, while in the absence of said external depressing force onto said tongue, the latter resiliently and automatically springs back to its original position.

The advantages of the device according to the invention are apparent from the above. The unitary cover for the regulator permits not only a considerable saving of material, but also a reduction of the finishing steps and, therefore, of the manufacturing time. In addition, it has much smaller overall dimensions and an exterior appearance which is aesthetically more attractive, while ensuring a optimum operating reliability.

I claim:

1. An automatic regulator for breathing apparatus, comprising a chamber which communicates with the breathing apparatus, including therein an air-dispensing valve, and a chamber which communicates with the environment, said chambers being sealingly separated from each other by means of a flexible membrane which controls said dispensing valve, while said chamber which communicates with the environment is defined exteriorly by a cover provided with pressure means acting on said membrane, for manual control of said dispensing valve, wherein said pressure means comprises a tongue which is obtained by a partial cut in said cover and which is resiliently deflected inward by an external depressing force, so as to deflect said membrane towards the interior of said camber which communicates with the breathing apparatus and to cause the opening of said dispensing valve.

2. A regulator according to claim 1, characterized in that said partial cut is in the form of a slit or slot.

3. A regulator according to claim 1, characterized in that a free end of said tongue extends to an intermediate region of said cover and said membrane and comprises, on an inner side thereof, a protrusion co-operating with a central region of said membrane.

4. A regulator according to claim 1, characterized in that said tongue is substantially rectangular with a rounded free end portion.

5. A regulator according to claim 1, characterized in that said tongue is of spiral form.

6. A regulator according to claim 1, characterized in that said cover is secured to the body of the regulator.

7. A regulator according to claim 6, characterized in that said cover is screwed to the body of the regulator.

8. A regulator according to claim 6, characterized in that said cover is joint-locked to the body of the regulator.

* * * * *